US006620020B2

(12) United States Patent
Marine

(10) Patent No.: US 6,620,020 B2
(45) Date of Patent: Sep. 16, 2003

(54) ELECTRICALLY INTERCONNECTED SNAP FOR DOLLS

(75) Inventor: Jon C. Marine, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/846,881

(22) Filed: May 1, 2001

(65) Prior Publication Data

US 2002/0164923 A1 Nov. 7, 2002

(51) Int. Cl.[7] ..... A63H 3/28
(52) U.S. Cl. ..... 446/298; 446/354; 434/393
(58) Field of Search ..... 446/97, 98, 268, 446/304, 305, 330, 352–354, 376, 484, 472, 298; 434/236, 393

(56) References Cited

U.S. PATENT DOCUMENTS 3,514,899 A * 6/1970 Bonanno et al. ..... 446/298
3,967,410 A * 7/1976 Hodska ..... 446/268
4,249,338 A * 2/1981 Wexler ..... 446/297
4,775,352 A 10/1988 Curran et al.
4,808,142 A 2/1989 Berliner
4,836,465 A 6/1989 May et al.
4,900,289 A 2/1990 May et al.
4,923,428 A 5/1990 Curran
5,096,424 A * 3/1992 Carlberg ..... 434/262
5,108,341 A 4/1992 DeSmet
5,399,115 A 3/1995 Arad et al.
5,820,441 A 10/1998 Pracas
5,855,502 A 1/1999 Truchsess
2002/0028427 A1 3/2002 Jurmain et al.

OTHER PUBLICATIONS

Instructions from "Amazing Ally" Doll of Playmates Toys Inc., 1999.

* cited by examiner

*Primary Examiner*—Derris H. Banks
*Assistant Examiner*—Bena B. Miller
(74) *Attorney, Agent, or Firm*—Kolisch Hartwell, P.C.

(57) ABSTRACT

An interactive, animated, robotic doll including a body, a processor, terminals linked to the processor, and a removable attachment. The terminals are connected to metal snaps on the body and the removable attachment includes complimentary snaps that secure the garment to the doll body. An electric circuit is completed when the attachment is secured by the snaps to the doll.

17 Claims, 2 Drawing Sheets

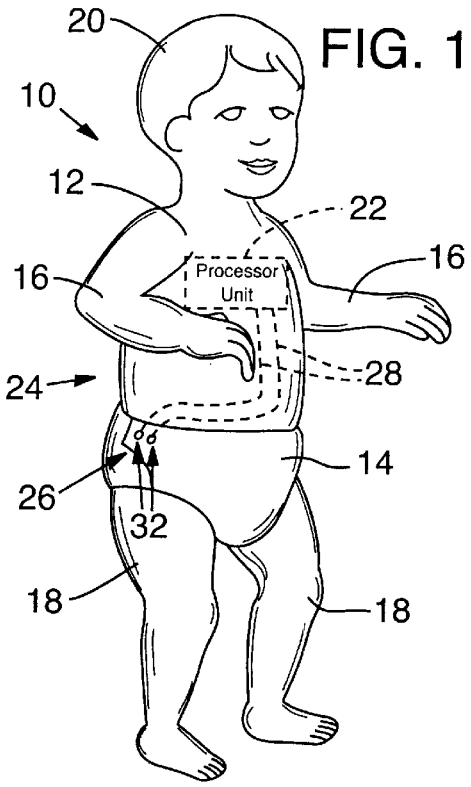
FIG. 1
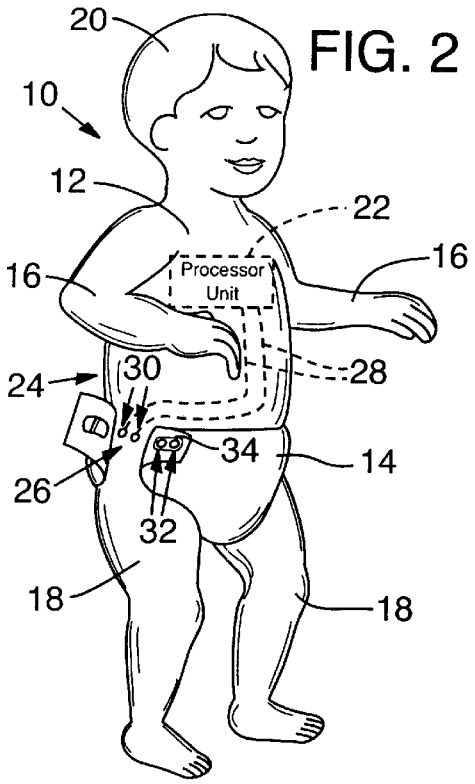
FIG. 2
FIG. 3
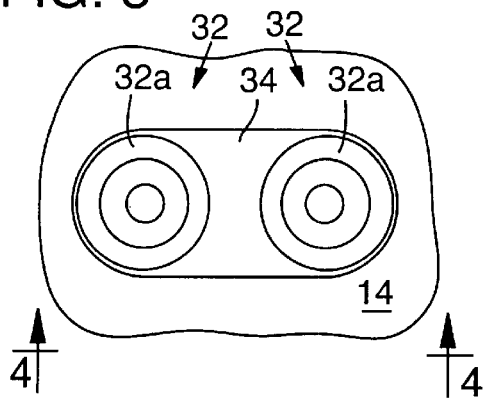
FIG. 5
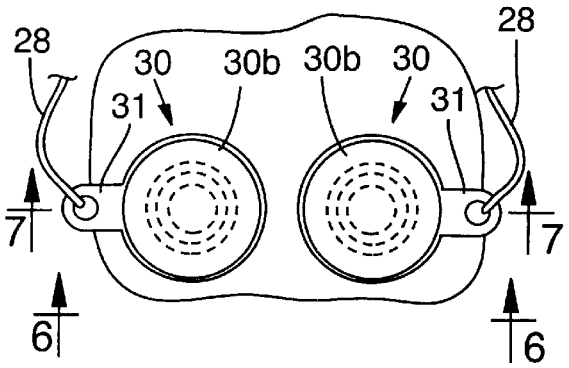
FIG. 4
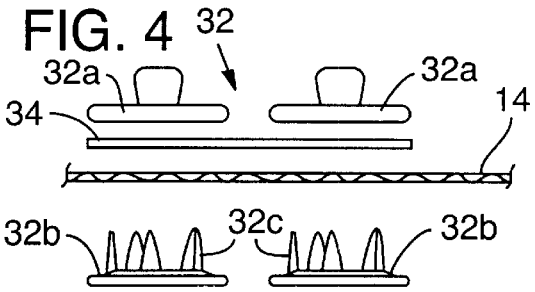
FIG. 6
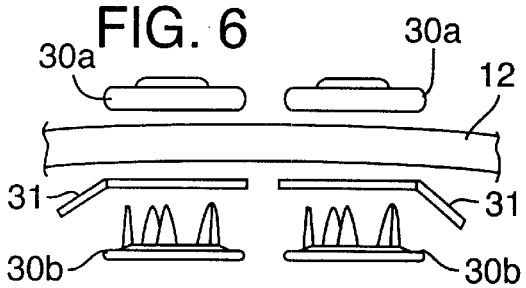

ELECTRICALLY INTERCONNECTED SNAP FOR DOLLS

FIELD OF THE INVENTION

The present invention relates generally to a sensor system for electronic toys, and more particularly to a system using electrically interconnected snaps for determining the presence of a removable attachment on an electronic doll. For example, it may be used as part of an electronic doll to make the doll say or do something in response to attaching or removing a diaper to or from the doll.

BACKGROUND OF THE INVENTION

Interactive toys are popular for children. Interactive toys having animated features and moving parts increase the life-like appearance of dolls and enhance the realistic characteristics of other toys, thus increasing the appeal of these toys to children. Examples of various interactive, animated or robotic dolls or other toys are found in U.S. Pat. Nos. 4,775,352, 4,808,142, 4,836,465, 4,900,289, 4,923,428, 5,108,341, 5,399,115, 5,820,441, and 5,855,502, the disclosures of which are incorporated herein by reference.

SUMMARY OF THE INVENTION

The present invention includes an interactive, animated and robotic doll having a body, a processor, terminals linked to the processor, and a removable garment. The terminals are connected to metal snaps on the body and the removable garment includes complimentary snaps that secure the garment to the doll body. An electric circuit is completed when the garment is secured by the snaps to the doll, and the processor alters the doll's behavior. By altering the doll's behavior based on the presence of the removable garment, the doll is more appealing to children. In the depicted embodiment, the doll resembles an infant and the removable attachment resembles a diaper.

The advantages of the present invention will be understood more readily after a consideration of the drawings and the Detailed Description.

BRIEF DESCRIPTION OF THE DRAWINGS

FIG. 1 is a simplified perspective view of a doll according to the present invention, taken from the front and to the right of the doll, showing a diaper attached to a body of the doll by snaps, and showing a processor and wiring contained within the body of the doll in dashed lines.

FIG. 2 is a perspective view of the doll of FIG. 1, showing the diaper partially removed from the body of the doll, with the snaps on the diaper detached from corresponding snaps on the body of the doll, and with the diaper pulled back to expose those corresponding snaps.

FIG. 3 is a plan view of a portion of the diaper of FIG. 2, showing the snaps and a conductive link that electrically interconnects the snaps.

FIG. 4 is an exploded side assembly view of the portion of the diaper of FIG. 3, viewed along line 4—4 in FIG. 3

FIG. 5 is a plan view of a potion of the interior of the body of the doll of FIG. 1, showing the snaps and associated wiring terminals.

FIG. 6 is an exploded side assembly view of the snap halves and terminals of FIG. 5, viewed along line 6—6 in FIG. 5.

DETAILED DESCRIPTION AND BEST MODE OF THE INVENTION

Figure 7:
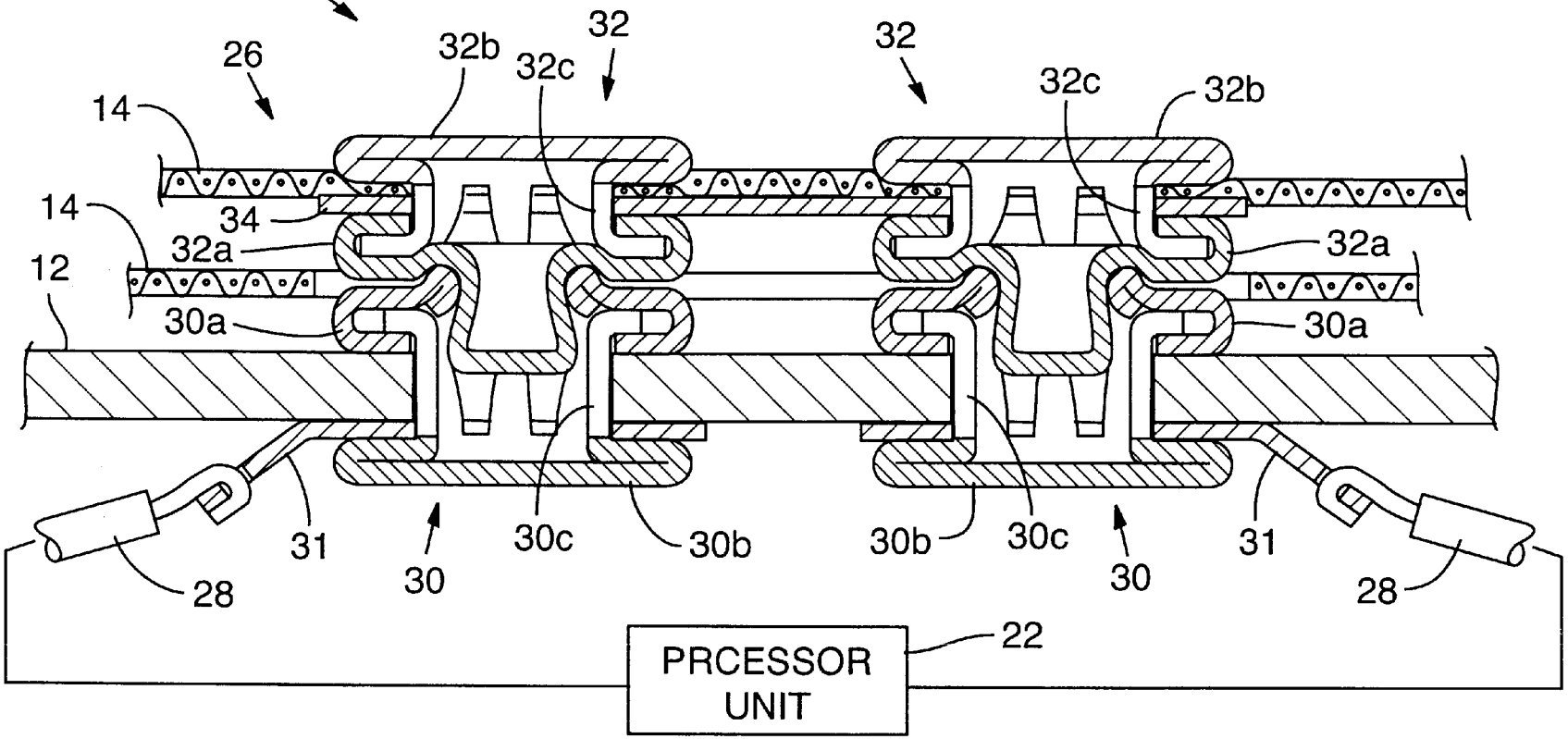
FIG. 7 is a cross sectional view of the body, snaps, diaper, link and terminals of FIGS. 1–6, taken along line 7—7 of FIG. 5, showing the interconnection of these parts, and including a schematic representation of the wiring and processor of the doll.

Referring initially to FIG. 1, a doll according to the present invention is generally indicated at 10. Doll 10 includes a body 12, which preferably is shaped to resemble an infant, and a garment 14, which preferably resembles a diaper. Alternatively, the doll may be configured to resemble an animal or any other creature, both real and imaginary.

Body 12 may include movable appendages such as arms 16, legs 18, and a head 20. Motors, gears or other mechanisms (not shown) also may drive the motion of these appendages, giving the doll robotic like attributes. A processor 22 may be contained within body 12 and configured to control the movement of these appendages. Similarly, doll 10 may include a speaker and lights to produce audible and visual responses. Processor 22 may also be configured to activate these audible and visual responses, such as speech and flashing lights.

Additionally, doll 10 includes a sensor subsystem 24 for determining the presence of garment 14 on body 12. Sensor subsystem 24 includes fastening structure 26 and wiring 28. Fastening structure 26 secures garment 14 to body 12 of doll 10. Wiring 28 forms an electric circuit connected to processor 22, electrically interconnecting processor 22 and fastening structure 26. Fastening structure 26 and wiring 28 cooperate with processor 22 to communicate the presence of garment 14, as explained below. Fastening structure 26 is configured such that wiring 28 may be connected to fastening structure 26.

Turning to FIG. 2, diaper 14 is partially removed from body 12 of doll 10, with fastening structure 26 shown in a detached configuration with a portion remaining connected to body 12 and a portion remaining connected to garment 14. Diaper 14 may be made of a pliant material to enable this partially removed, folded-back configuration, if desired, or diaper 14 may be made of a harder, less pliable material, not shown. Fastening structure 26 preferably is a set of snaps, which include doll-side snaps 30 having terminal connectors 31 for attaching wiring 28, and diaper-side snaps 32 which are electrically linked together by a link 34. It should be understood that fastening structure 26, while shown as snaps, could be some other suitable structure that attaches the garment to the doll and is capable of completing an electric circuit. Terminal connectors 31 may be integral with fastening structure 26 forming part of the aforementioned electric circuit. Doll-side snaps 30 may also be referred to as body-side snaps 30. Diaper-side snaps 32 also may be referred to as garment-side, attachment-side, or accessory-side snaps 32.

Diaper-side snaps 32 and link 34 are shown in more detail in FIGS. 3 and 4. Link 34 electrically connects the two diaper-side snaps 32 on diaper 14. As a result of the electrical connection between diaper-side snaps 32, a completed electric circuit is formed when diaper-side snaps 32 are mechanically coupled to doll-side snaps 30. Completion of this electric circuit causes processor 22 to produce predetermined responses, such as increased movement of legs 18 and arms 16, or an audible or visual response.

Referring now to FIG. 4, the diaper-side snaps include an upper snap piece 32*a* and a lower snap piece 32*b*. Snap pieces 32*a* and 32*b* are designed to punch through diaper 14 and mechanically interlock when prongs 32*c* of lower snap piece 32*b* curl over, inside upper snap piece 32*a*, when the assembly is pressed together to form completed snaps 32. Link 34 is configured to allow prongs 32*c* of lower snap piece 32*b* to pass through an aperture, or series of apertures, so that the diaper-side snap 32 sandwiches link 34 and a portion of diaper 14 between upper snap piece 32*a* and lower snap piece 32*b*. This sandwich configuration electronically links the two diaper-side snaps 32, such that when attached to doll-side snaps 30 an electric circuit is completed.

Turning to FIGS. 5 and 6, doll-side snaps 30 are shown in more detail. Each doll-side snap 30 includes an upper snap piece 30*a* and a lower snap piece 30*b*. Lower snap piece 30*b* includes prongs 30*c* that are configured to push through body 12 and fold back upon themselves as upper and lower snap pieces 30*a* and 30*b* are pressed together. Electric terminals 31 and a portion of body 12 are sandwiched between upper and lower snap pieces 30*a* and 30*b* such that electric terminals 31 are in electric connection with doll-side snaps 30 after the upper snap pieces and lower snap pieces 30*a* and 30*b* are pressed together. Wires 28 are connected at one end to electric terminals 31 and at another end to processor 22.

Turning to FIG. 7, a cross-section of sensor subsystem 24 is shown with the portions of fastening structure 26 interconnected. The sensor subsystem shows diaper-side snaps 32 secured to doll-snaps 30 and link 34 completing the circuit formed by wiring 28 and processor 22. Upon completion of the circuit, sensor subsystem 24 communicates the presence of garment 14 to processor 22.

Doll-side snaps 30 and diaper-side snaps 32 are shown pressed together with prongs 30*c*, and 32*c*, folded over to lock the upper pieces 30*a* and 32*a* to lower pieces 30*b* and 32*b*. Prongs 30*c* pass through body 12 and terminals 31 securing snaps 30 in place. Prongs 32*c* pass through diaper 14 and link 34 securing snaps 32 in place. Processor 22 may be configured to perform a number of tasks in response to the connection of garment 14.

It should be understood that garment 14, shown in the depicted embodiment as a diaper, may include other removable accessories for example, but not limited to, a purse, jewelry, a watch, glasses, a hat, etc. The location of fastening structure 26 may be adjusted to accommodate the type of removable accessory used on other embodiments of the present invention.

It should further be understood, that while doll-side snaps 30 are shown as female-type snap portions and diaper-side snaps 32 are shown as male-type snap portions, various reversals of these parts may be included within the present invention. Additional types of fastening structures may be used provided they are capable of completing the electric circuit formed by terminals 31, wiring 28 and processor 22.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A doll, comprising:

a body having a processor substantially enclosed within the body;

a pair of terminals positioned on the body including integral doll side fastening structure, wherein the pair of terminals are each electrically linked to the processor as part of an electric circuit; and a removable attachment having attachment side fastening structure configured to couple to the doll side fastening structure of the terminals securing the attachment to the doll, and wherein the attachment side fastening structure is linked to complete the electric circuit through the removable attachment when attached to the doll.

2. The doll of claim 1, wherein the removable attachment includes a pliant garment configured to conform to the doll.

3. The doll claim 2, wherein the pliant garment includes a diaper.

4. A doll, comprising:

a body having a processor substantially enclosed within the body;

a pair of terminals positioned on the body including integral doll side fastening structure including female snap portions wherein the pair of terminals are each electrically linked to the processor as part of an electric circuit; and a removable attachment having attachment side fastening structure including male snap portions configured to couple to the doll side fastening structure of the terminals securing the attachment to the doll, and wherein the attachment side fastening structure is linked to complete the electric circuit when attached to the doll.

5. The doll of claim 1, wherein the doll is a robotic doll.

6. A doll system for sensing the presence of an attachment, the doll system comprising:

an electric doll having a processor unit;

a removable attachment configured to attach to and detach from the electric doll; and a sensor subsystem having an attachment-side connector positioned on the removable attachment and a pair of doll-side terminals configured to electrically link to the processor unit positioned on the doll, wherein the attachment-side connector includes fastening structure and the doll-side terminals include fastening structure integral with the terminals and adapted to couple to the fastening structure of the attachment-side connector, and further wherein when the removable attachment is attached to the doll, the attachment-side connector electrically couples to the doll-side terminal to complete an electric circuit through the removable attachment and thereby send a signal to the processor unit indicating when the removable attachment is attached to, and detached from, the electric doll.

7. A doll system for sensing the presence of an attachment, the doll system comprising:

an electric doll having a processor unit;

a removable attachment configured to attach to and detach from the electric doll; and a sensor subsystem having an attachment-side connector positioned on the removable attachment and a pair of doll-side terminals configured to electrically link to the processor unit positioned on the doll, wherein the attachment-side connector includes fastening structure including male snap portions and the doll-side terminals include fastening structure including female snap portions integral with the terminals and adapted to couple to the fastening structure of the attachment-side connector, and further wherein when the removable attachment is attached to the doll, the attachment-side connector electrically couples to the doll-side terminal to complete an electric circuit and thereby send a signal to the processor unit indicating when the removable attachment is attached to, and detached from, the electric doll.

8. The doll system of claim 6, wherein the removable attachment is a pliant garment.

9. The doll system of claim 8, wherein the pliant garment is a diaper.

10. The doll system of claim 6, wherein the electric doll is a robotic doll.

11. The doll system of claim 10, wherein the robotic doll resembles an infant.

12. A doll, comprising:

a body;

a processor contained within the body of the doll;

split terminals each electrically linked to the processor as part of an electrical circuit and forming a fastening structure; and a garment configured to attach to the fastening structure of the split terminals of the doll, thereby completing the electrical circuit and holding the garment in place on the body of the doll, wherein the electrical circuit passes through the removable attachment.

13. A doll, comprising:

a body;

a processor contained within the body of the doll;

split terminals each electrically linked to the processor as part of an electrical circuit and forming a fastening structure including female snap portions; and a garment including male snap portions configured to attach to the fastening structure of the split terminals of the dolt, thereby completing the electrical circuit and holding the garment in place on the body of the doll.

14. The doll of claim 12, wherein the garment includes a pliant portion.

15. The doll of claim 12, wherein the pliant garment is a diaper.

16. The doll of claim 12, wherein the doll is a robotic doll.

17. The doll of claim 16, wherein the robotic doll resembles an infant.

* * * * *